US005799519A

United States Patent [19]

Hsiao

[11] Patent Number: 5,799,519

[45] Date of Patent: Sep. 1, 1998

[54] REPEATABLE CODING LOCK

[76] Inventor: Yao-shiung Hsiao, No. 1-3, Ting Liao, Shuishang Hsiang, Chiayi Hsien, Taiwan

[21] Appl. No.: 735,129

[22] Filed: Oct. 22, 1996

[51] Int. Cl.[6] ..... E05B 27/06

[52] U.S. Cl. ..... 70/358; 70/383

[58] Field of Search ..... 70/356, 358, 382–385, 70/493, 375

[56] References Cited

U.S. PATENT DOCUMENTS

| | | | |
|---|---|---|---|
| 3,656,328 | 4/1972 | Hughes | 70/358 |
| 3,742,744 | 7/1973 | Lumme | 70/358 |
| 3,943,739 | 3/1976 | Genakis | 70/375 X |
| 4,612,787 | 9/1986 | Prunbauer et al. | 70/358 |
| 4,732,023 | 3/1988 | Shen | 70/383 |
| 4,836,002 | 6/1989 | Monahan | 70/358 |
| 5,485,735 | 1/1996 | Laabs et al. | 70/358 |
| 5,617,750 | 4/1997 | Preddey | 70/356 X |
| 5,685,184 | 11/1997 | Gallagher | 70/358 |

*Primary Examiner*—Suzanne Dino

*Attorney, Agent, or Firm*—Michaelson & Wallace; Peter L. Michaelson; John C. Pokotylo

[57] ABSTRACT

A lock for use with a lock code setting key and a new lock code setting key, and having (a) a first cylindrical tube with a first radially extending slot for receiving a first biasing element and a first locking element, (b) a driving element having an axially extending key hole and a radially extending peripheral hole for receiving a second locking element, and (c) a second cylindrical tube arranged between the first cylindrical tube and the driving element and having a radially extending through hole for receiving a third locking element and a radially extending positioning hole for receiving a second biasing element and a fourth locking element. A locking code of the lock can be changed by (a) inserting the lock code setting key into the keyhole thereby positioning the third locking element such that a first end is aligned with the first interface and a second end is aligned with the second interface, (b) turning the lock code setting key such that the second biasing element pushes the fourth locking element against the second locking element, (c) removing the lock code setting key from the keyhole, and (d) inserting the new lock code setting key into the keyhole.

13 Claims, 8 Drawing Sheets

REPEATABLE CODING LOCK

FIELD OF THE INVENTION

The present invention relates to a repeatable coding lock, and more particularly to a coding lock having a repeatable coding mechanism.

BACKGROUND OF THE INVENTION

A lock is well known for the sake of safety and is mainly used to guard against theft, keeping out unauthorized personnel, etc., which can generally be classified into padlocks, shackle locks, three-cylinder locks, and so forth. Referring to FIG. 1, no matter what the variations will be, a lock's basic constitution includes a first driver 95, a second driver 90 sleeved over the first driver 95 and a tube 98 mounted on the second driver 90, and is fitted on a door for above mentioned purpose. The first driver 95 has in its center a locking through strip 96 and contains many locking means 93 and 94 having therewith springs 92. Each set of the locking means 93 and 94 and the spring 92 are embedded between the first driver 95 and the second driver 90. The aspect of the different lengths among the locking means 93 and 94 protruding beyond the locking through strip 96 in conjunction with the indented inserting slot of a key 100 relative to the locking means 94 prevent the interface between the first driver 95 and the second diver 90 from any resistance of the locking means 93 and 94 so as to transmit the first driver 95 with the key 100 to withdraw the locking tongue in order to release the locked state. As a result, a conventional lock is only suitable for its counterpart key. If, for some reason, the key has to be replaced, the whole lock set has to be replaced, too. This causes not only great inconvenience but also unnecessary expense.

Consequently, from the above considerations, there has been a long and unfulfilled need for a lock having the repeatable coding function.

SUMMARY OF THE INVENTION

The main object of the present invention is to provide a repeatable coding lock to set a new code with the different widths or the different lengths of the setting key and the opening key so as to prevent the new coding formation from being unlocked with the old keys.

Another object of the present invention is to provide a repeatable coding lock whose locking formation can be changed to match with that of a new key so as to save both money and the re-assembly time of a new lock when a new lock set is required.

In accordance with a first aspect of the present invention, a repeatable coding lock comprises a tube having a first slot for receiving therein a first elastic element and a first locking element, a first driver having a locking through strip and a peripheral hole for receiving therein a second locking element and a second driver having a through hole for receiving therein a third locking element so as to externally correspondingly position at the tube and internally axially contain the first driver and the second driver, which is characterized in that the second driver further comprises at one side parallel to the through hole a positioning hole for receiving therein a second elastic element and a fourth locking element and comprises, in correspondence with the locking through strip, a driving means for simultaneously driving the first driver and the second driver.

In accordance with a second aspect of the present invention, the driving means is an opening slot.

In accordance with a third aspect of the present invention, the second driver has at one end a stopper having an opening slot corresponding to the locking through strip.

In accordance with a fourth aspect of the present invention, the driving means consists of a ball in the through hole.

In accordance with a fifth aspect of the present invention, the tube further comprises a second slot which in an instance is adapted to be penetratingly in alignment with the positioning hole to define an inner slot for superposingly receiving therein a third elastic element and the fourth locking element.

In accordance with a sixth aspect of the present invention, the positioning hole receives therein a magnet and a magnetic pin.

In accordance with a seventh aspect of the present invention, the tube is adapted to associate with a locking body fixedly mounted on a door.

In accordance with an eighth aspect of the present invention, the first elastic element and the second elastic element are a spring.

In accordance with an ninth aspect of the present invention, a repeatable coding lock comprises a tube having a first slot for receiving therein a first elastic element and a first locking element, a first driver having a locking through strip and a peripheral hole for receiving therein a second locking element and a second driver having a through hole for receiving therein a third locking element so as to externally correspondingly position at the tube and internally axially contain the first driver and the second driver, which is characterized in that the tube further comprises a second slot for receiving therein a second elastic element, the first driver further comprises a first stopping element at a location different from the peripheral hole, and the second driver further comprises at one side parallel to the through hole a positioning hole for receiving therein a fourth locking element and forms in correspondence with the first stopping element a second stopping element.

In accordance with a tenth aspect of the present invention, a repeatable coding lock comprises a tube having a first slot for receiving therein a first elastic element and a first locking element, a first driver having a locking through strip and a peripheral hole for receiving therein a second locking element and a second driver having a through hole for receiving therein a third locking element so as to externally correspondingly position at the tube and internally axially contain the first driver and the second driver, which is characterized in that the tube further comprises a second slot for receiving therein a second elastic element and being provided with a cavity, the first driver further comprises at a location different from the peripheral hole a positioning slot for receiving therein a third elastic element and a stopping pin, and the second driver further comprises a side hole and a positioning hole for receiving therein a fourth locking element.

In accordance with an eleventh aspect of the present invention, the positioning slot may be provided in the tube and the cavity may be provided in the first driver.

The present invention may best be understood through the following description with reference to the accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
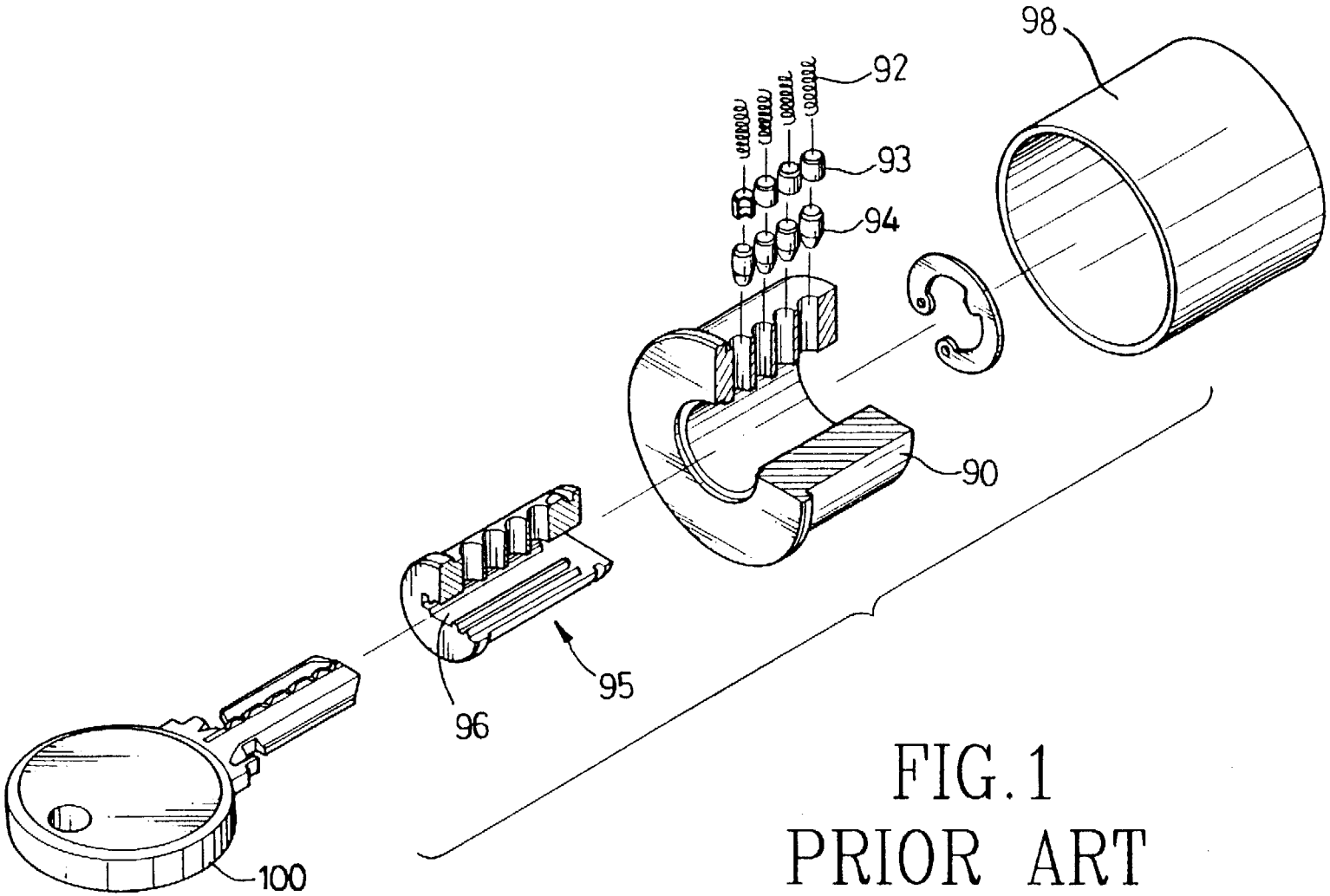
FIG. 1 PRIOR ART
FIG. 1 is an exploded view schematically showing the elements of a prior coding lock.
Figure 2:
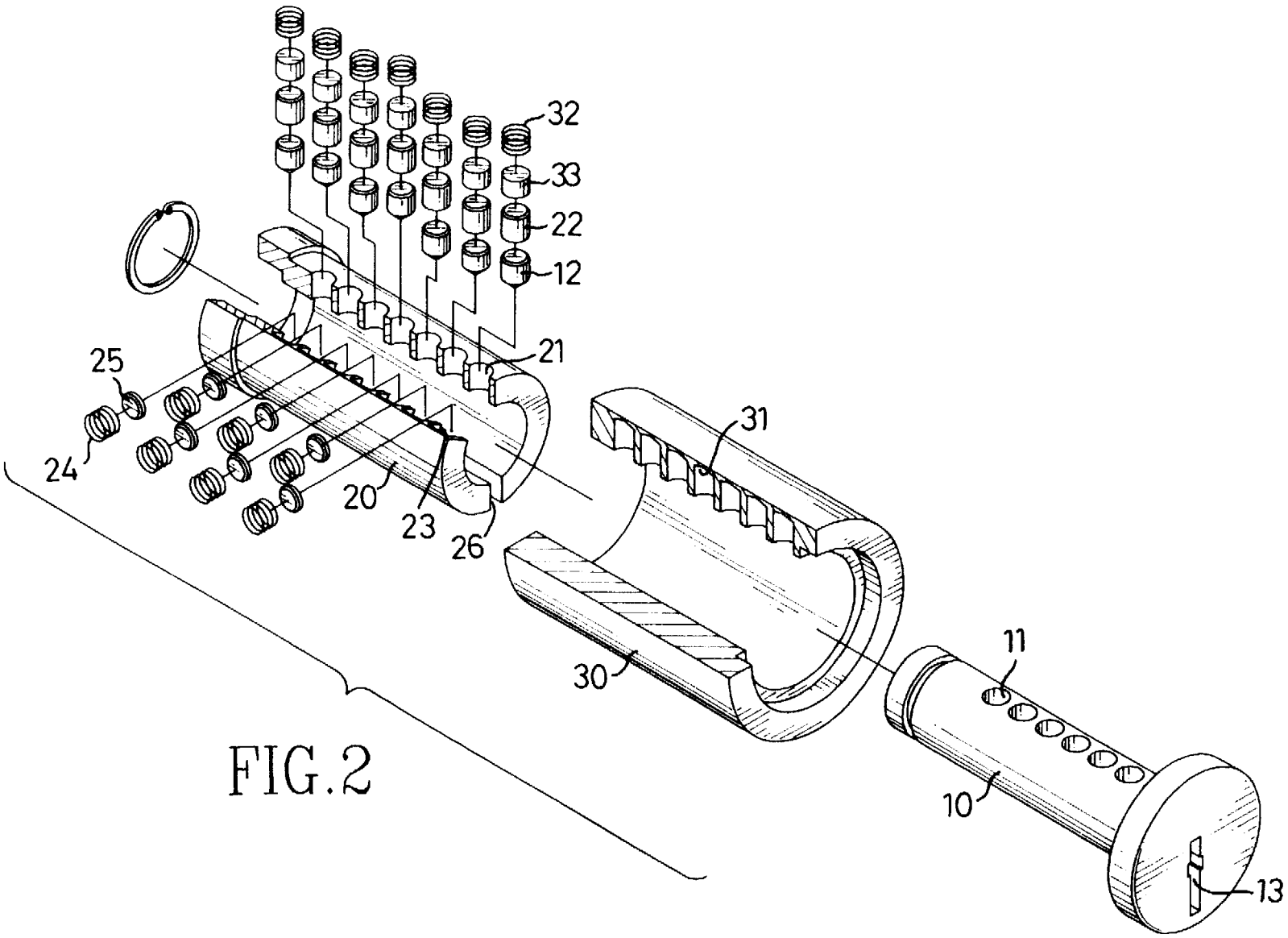
FIG. 2 is an exploded view schematically showing the elements of a first preferred embodiment of a repeatable coding lock according to the present invention.
Figure 3:
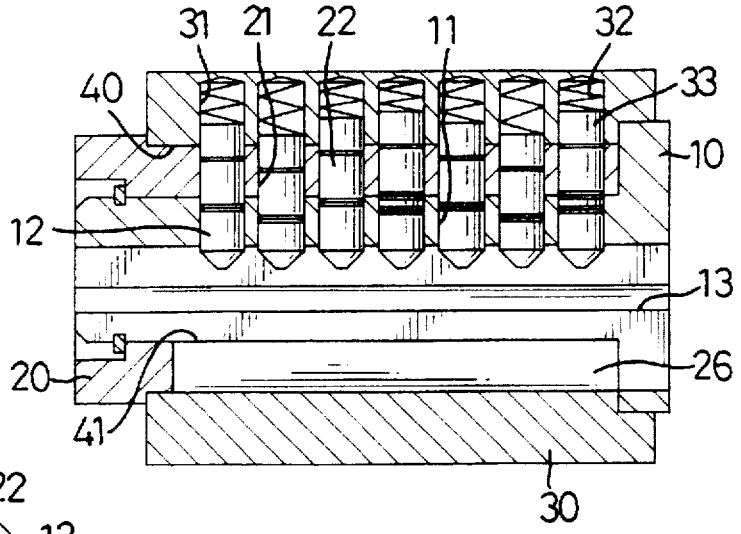
FIG. 3 is a sectional view longitudinally showing a first preferred embodiment of a repeatable coding lock according to the present invention.

Referring to FIG. 2, the repeatable coding lock of the present invention consists of a first driver 10, a second driver 20 sleeved over the first driver 10 and a tube 30 mounted on the second driver 20, wherein the tube 30 can associate with any locking body to be mounted on a door. According to FIG. 3 showing the internal assembly layout, the tube 30 radially indentedly accommodates along the longitudinal direction at least one first slot 31 for respectively receiving therein a first elastic element 32 and a first locking element 33. The second driver 20 is adheringly sleeved inside the tube 30 to form therebetween a turning interface 40 and, in correspondence to the first slot 31, has the same number of the through holes 21 for respectively receiving a third locking element 22; also, referring to FIG. 4, the second driver 20 adjacently parallel to each of the through holes 21 has a positioning hole 23 for receiving therein a second elastic element 24, a fourth locking element 25 and, in a proper position, a driving means which is adapted to be transmitted by a key. In a preferred embodiment, the driving means can be a designation of an opening slot 26. The first driver 10 sleeves inside the second driver 20 to form therebetween a setting interface 41, which centrally has a locking through strip 13 for accommodating a key and has in correspondence to each of the through holes 21 a peripheral hole 11 for receiving a second locking element 12. Besides, each of the peripheral holes 11 penetratingly connects with the locking through strip 13 so as to correspondingly engage with a key.

Figure 4:
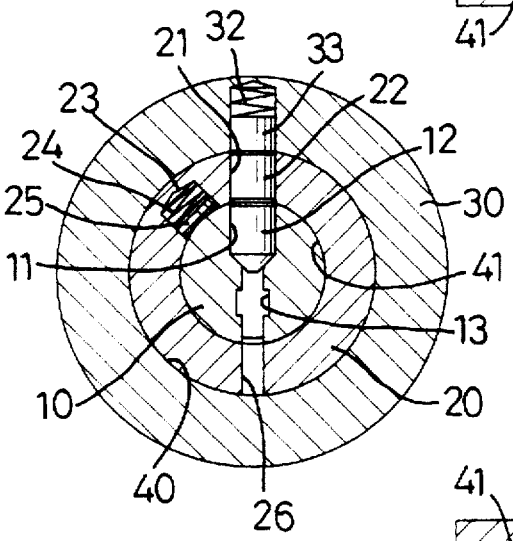
FIG. 4 is a sectional view transversely showing a first preferred embodiment of a repeatable coding lock according to the present invention.

The above mentioned layout will be more clearly illustrated as shown in FIG. 4 in that the second driver 20 and the tube 30 can relatively move on both sides of the turning interface 40, while the first driver 10 and the second driver 20 can relatively move on both sides of the setting interface 41. The peripheral hole 11 is provided with a tapered end to correspondingly engage with that of the lower corn-end of the second locking element 12 in order to stop the second locking element 12 from dropping off. The first elastic element 32, the first locking element 33, the third locking element 22 and the second locking element 12 are sequentially inwardly aligned along. Also, each of the positioning holes 23 is adjacently located at one side of each of the arrangement of the first locking element 33, the third locking element 22 and the second locking element 12.

Figure 5:
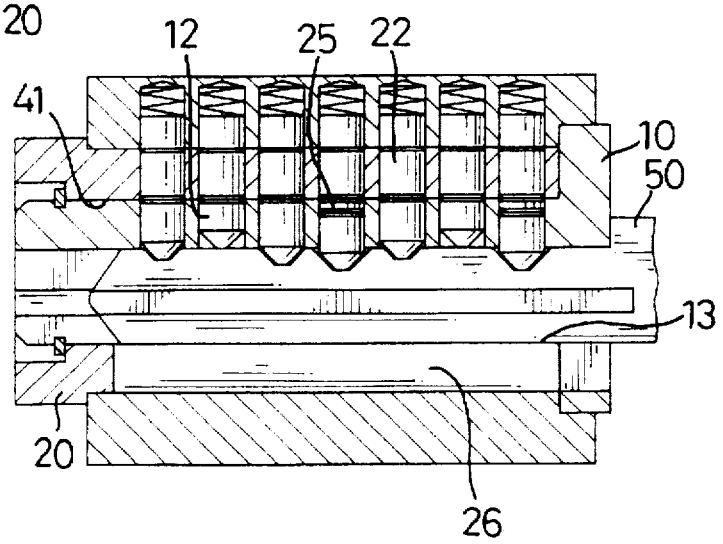
FIG. 5 is a sectional view longitudinally showing an original setting key inserted in a first preferred embodiment of a repeatable coding lock according to the present invention.
Figure 6:
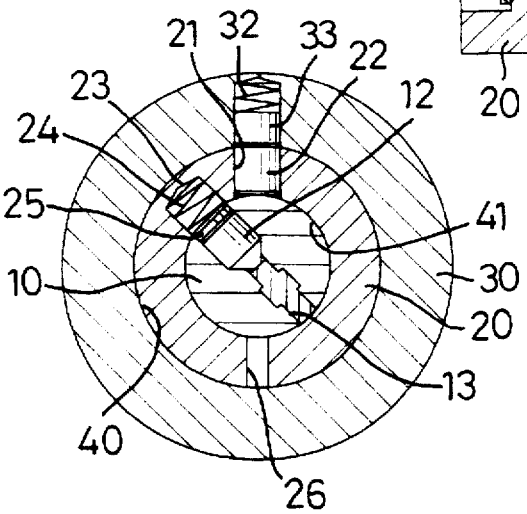
FIG. 6 is a sectional view transversely showing an original setting key transmitting the first driver to align the second locking means with the positioning hole in a first preferred embodiment of a repeatable coding lock according to the present invention.
Figure 8:
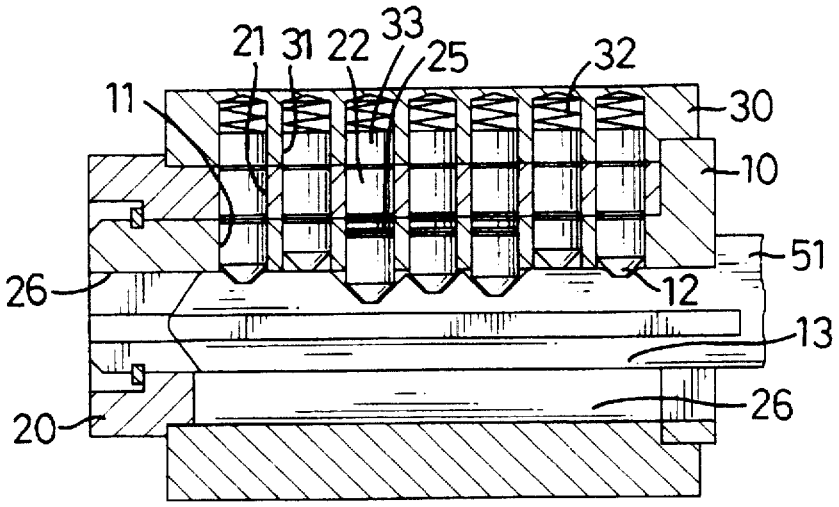
FIG. 8 is a sectional view longitudinally showing a new setting key turning the first driver to its original place in a first preferred embodiment of a repeatable coding lock according to the present invention.
Figure 7:
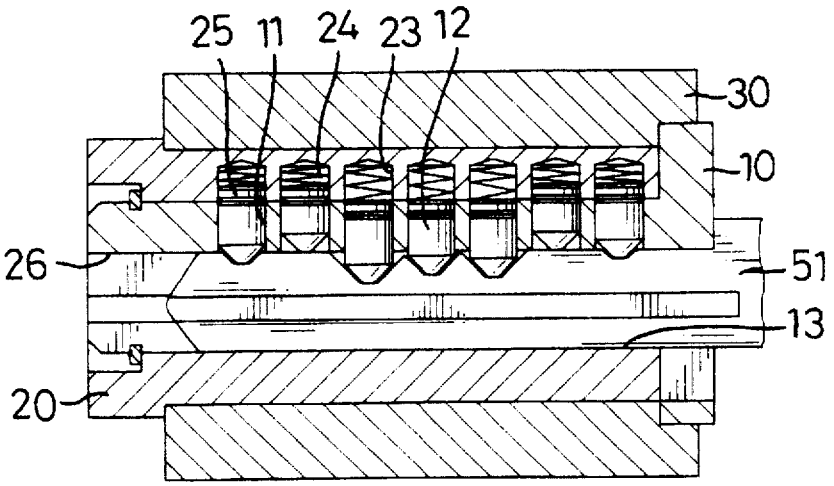
FIG. 7 is a sectional view longitudinally showing a new setting key inserted in the first driver to change the position of the fourth locking means inside the first driver in a first preferred embodiment of a repeatable coding lock according to the present invention.

Referring to FIG. 5, a method of setting a new locking formation will be depicted herein. Firstly, with the indented teeth of an original setting key 50 inserted in the locking through strip 13, the lower end of each third locking element 22 is aligned with the setting interface 41. Since the radial width of the original setting key 50 is narrower than that of the opening key, the bottom end of the original setting key 50 does not reach into the opening slot 26 when the original setting key 50 is inserted in the locking through strip 13; consequently, when the original setting key 50 is turned, the second driver 20 will be inactive and the second locking element 12 taken along with the first driver 10 will be turned to the positioning hole 23. Further on, referring to FIG. 6, the fourth locking element 25 inside the positioning hole 23 will be ejected out by the second elastic element 24 due to the release of the setting interface 41 when the original key 50 is deviated from the locking through strip 13, which attachingly presses the second locking element 12 to become a vertical superimposition. Secondly, referring to FIG. 7, in respondence to the indented teeth of a new setting key 51 inserted in the locking through strip 13, the positions of the respective fourth locking elements 25 will be either in the peripheral hole 11 or in the positioning hole 23. And, when the new setting key 51 is further turned, the first driver 10 will be transmitted back to its initial position so as to again correspondingly align the peripheral hole 11 with the through hole 21 and the first slot 31. Consequently, referring to FIG. 8, the fourth locking element 25 taken from the positioning hole 23 to the peripheral hole 11 is vertically in alignment with the third locking element 22 and the first locking element 33 so as to make a change to the length of each of the second locking elements 12 protruding beyond the opening slot 26 and in turn form a new locking formation compared with that shown in FIG. 5. As a result, the original opening key and the original setting key 50 can no longer be used. And at this moment, a new opening key having the same indented teeth as those of the new setting key 51 and having larger radial width than that of the new setting key 51 is able to open the lock due to the aspect that the new opening key having larger radial width can be inserted in the opening slot 26 of the second driver 20 to simultaneously transmit the first driver 10 and the second driver 20 so as to accomplish this function.

Figure 9:
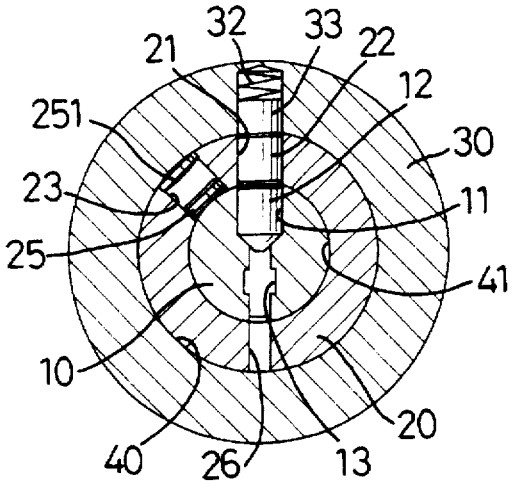
FIG. 9 is a sectional view transversely showing a fourth locking means in a second preferred embodiment of a repeatable coding lock according to the present invention.

The first slot 31, the through hole 21 and the peripheral hole 11 according to the present invention can be axially arranged in more than two lines, the positioning hole 23 is adjacently located at one side of the through hole 21. The indented teeth of the key can be applied on both lateral edges of the key tongue, on the upper and the lower edges of the key tongue or on more than two edges of a key tongue, such as a key having a cruciform cross-section tongue. In another preferred embodiment of the present invention, referring to both FIG. 4 and FIG. 9 as a comparison, the second elastic element 24 can be replaced with a magnet 251, while the fourth locking element 25 can be replaced with a magnetic pin. As a matter of fact, the magnet 251 and the magnetic pin can repulse each other with a repulsion similar to the functionality as elasticity exerted between the second elastic element 24 and the fourth locking element 25 in the previous preferred embodiment.

Figure 10:
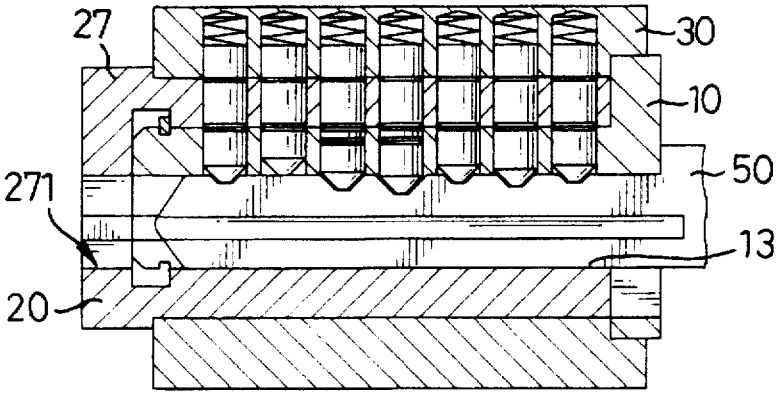
FIG. 10 is a sectional view longitudinally showing a driving means of a second driver in a second preferred embodiment of a repeatable coding lock according to the present invention.
Figure 11:
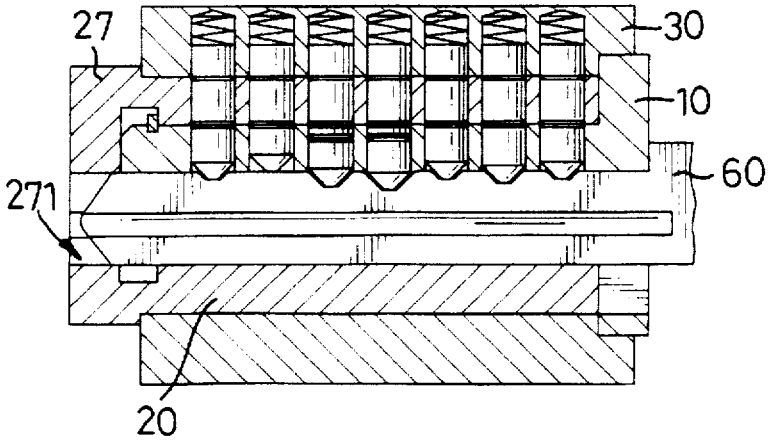
FIG. 11 is a sectional view longitudinally showing a new opening key simultaneously transmitting the first driver and the second driver in a second preferred embodiment of a repeatable coding lock according to the present invention.

Referring to FIG. 10 which shows a second preferred embodiment of a repeatable coding lock according to the present invention, the second driver 20 has at its inner end a stopper 27 having an opening slot 271 corresponding to the locking through strip 13. Consequently, since the longitudinal length of the setting key 50 is shorter than that of an opening key 60, the tip of the setting key 50 will stay in the first driver 10 in order that turning the setting key 50 can only transmit the driver 10 to set the locking formation. And at this moment, referring to FIG. 11, when inserted in the locking through strip 13, the tip of the opening key 60 can reach into the opening slot 271 so as to simultaneously transmit the first driver 10 and the second driver 20 in order to open and shut the lock without interrupting the coding.

Figure 12:
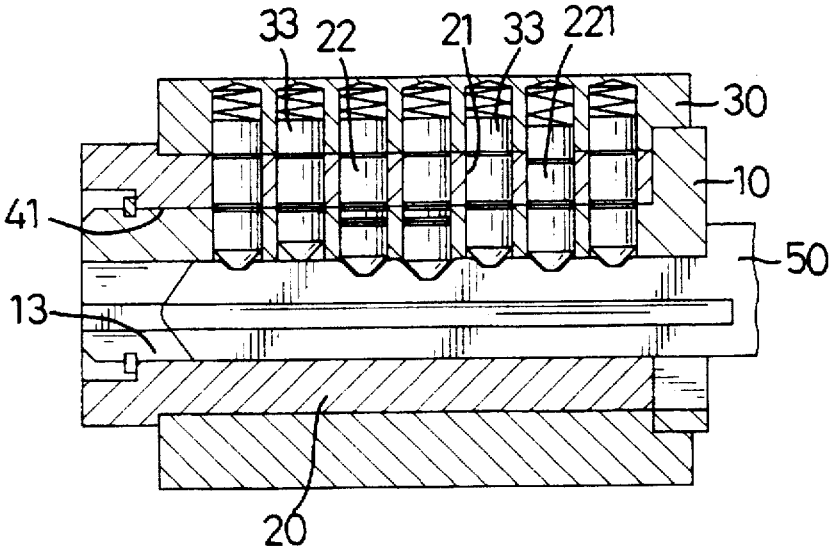
FIG. 12 is a sectional view longitudinally showing a second driver containing a ball in a third preferred embodiment of a repeatable coding lock according to the present invention.
Figure 13:
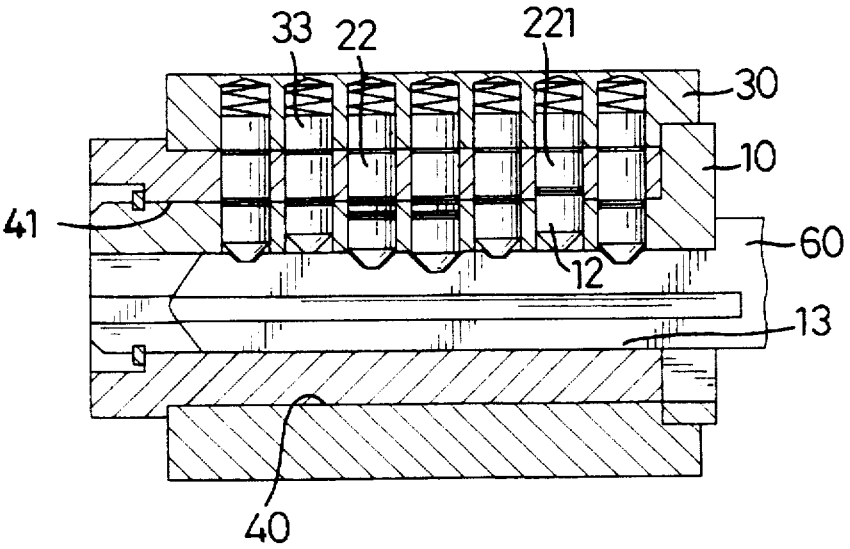
FIG. 13 is a sectional view longitudinally showing a new opening key inserted in a second driver containing a ball in a third preferred embodiment of a repeatable coding lock according to the present invention.

Referring to FIG. 12 which shows a third preferred embodiment of a repeatable coding lock according to the present invention, each of the at least one through holes 21 contains a cylinder 221. When the setting key 50 is inserted in the locking through strip 13, the lower bound and the upper bound of each of the third locking elements 22 are respectively aligned with the setting interface 41 and the turning interface 40, while the bottom bound of the ball (or pin) 221 is aligned with the setting interface 41. Also, the first locking element 33 passing through the through hole 21 is hindered at the upper bound of the ball (or pin) 221 so as to restrain the second driver 20 and the tube 30 and keep the first driver 10 movable in order to accomplish the coding. And, referring to FIG. 13, when the opening key 60 is inserted in the locking through strip 13, it is able to hinder all the second locking elements 12 respectively corresponding to all the balls (or pins) 221 with a specific tooth surface, transmit the second locking element 12 to pass through the through hole 21 and to hinder at the bottom of the ball (or pin) 221 so as to forcibly restrain the first driver 10 and the second driver 20 which are in turn adapted to turn simultaneously. Further, since the upper bound of the ball 221 as well as the third locking element 22 are aligned with the turning interface 40, the first driver 10 and the second driver 20 can be turned simultaneously to open the lock when the opening key 60 is turned.

Figure 14:
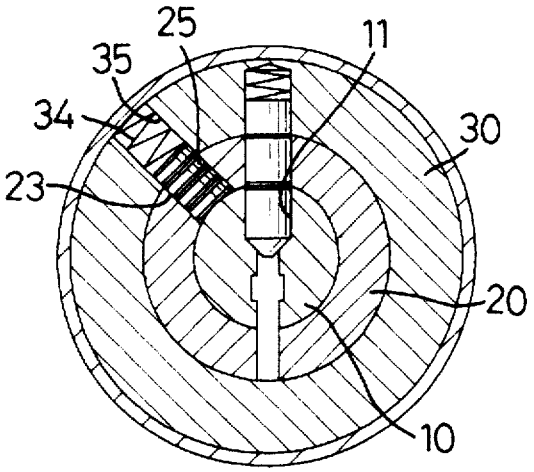
FIG. 14 is a sectional view transversely showing a tube provided with a second slot containing a fourth locking means in a fourth preferred embodiment of a repeatable coding lock according to the present invention.

Referring to FIG. 14 which shows a fourth preferred embodiment of a repeatable coding lock according to the present invention, tube 30 further comprises a second slot 35 which in an instance is adapted to be penetratingly in alignment with the positioning hole 23 to define an inner slot for superimposingly receiving therein a third elastic element 34 and the fourth locking element 25. When setting a new code, the peripheral hole 11 can accommodate at least one of the fourth locking elements 25 so as to enlarge the range of the height difference of a combination of the second locking element 12 and the third locking element 22 in order to increase the coding variety which also contributes to the designation of the indented inserting slot of a setting key.

Figure 15:
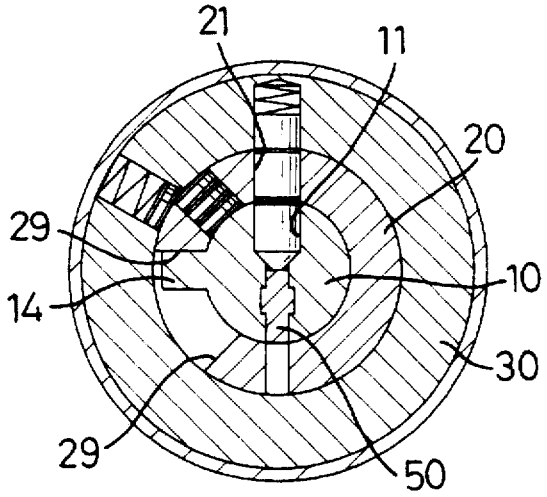
FIG. 15 is a sectional view transversely showing a first driver provided with a first stopping element and a second driver provided with a second stopping element in a fifth preferred embodiment of a repeatable coding lock according to the present invention.
Figure 17:
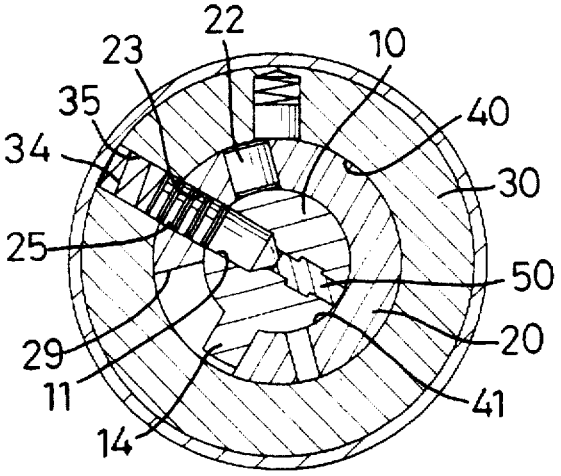
FIG. 17 is a sectional view transversely showing a first stopping element already engaged with a second stopping element in a fifth preferred embodiment of a repeatable coding lock according to the present invention.
Figure 16:
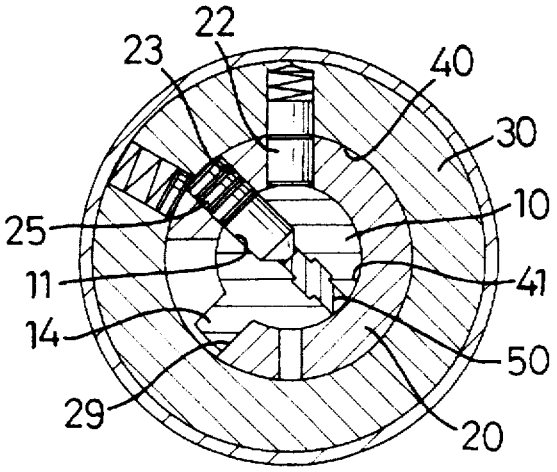
FIG. 16 is a sectional view transversely showing a first stopping element approaching a second stopping element in a fifth preferred embodiment of a repeatable coding lock according to the present invention.

In a fifth embodiment according to FIG. 15, the repeatable coding lock is adapted to prevent an inadequate opening, such as a theft committed with a universal key, so as to confirm the secrecy of the coding formation. And there are two designations capable of performing the above mentioned functionality. The first designation referring to FIG. 15 is that the first driver 10 further comprises a first stopping element 14 at a location different from the peripheral hole 11 and the second driver 20 further forms in correspondence with the first stopping element 14 a second stopping element 29. The first stopping element 14 movably turns between the two ends of the second stopping element 29. One of the two ends is at the position when the peripheral hole 11 radially aligns with the through hole 21, while the other one, as shown in FIG. 16, is at the position when the first driver 10 is transmitted to turn the peripheral hole 11 to align with the positioning hole 23. This method begins with turning the setting key 50 to transmit the first driver 10 as illustrated in FIG. 17. If the setting key 50 is an adequate one, the first stopping element 14 contacts with the second stopping element 29 at one end and the upper bond of the third locking element 22 is in alignment with the turning interface 40. Turning the key 50 further, the second driver 20 is transmitted by the first stopping element 14 in order to set the positioning hole 23, the second slot 35 and the peripheral hole 11 in alignment so as to accomplish the coding. If the setting key is not adequate, even though the second locking element 12, the third locking element 22 and the fourth locking element 25 can be excluded from the setting interface 41 to make the first driver 10 in a movable state, the turning interface 40 will stopped by any of the third locking elements 22 and the first elastic element 32 if any one of the fourth locking elements 25 is wrongly placed. Under such circumstance, the second driver 20 can no longer be transmitted by the first stopping element 14 to proceed the coding and accordingly accurately fulfill the secrecy of the designation.

Figure 18:
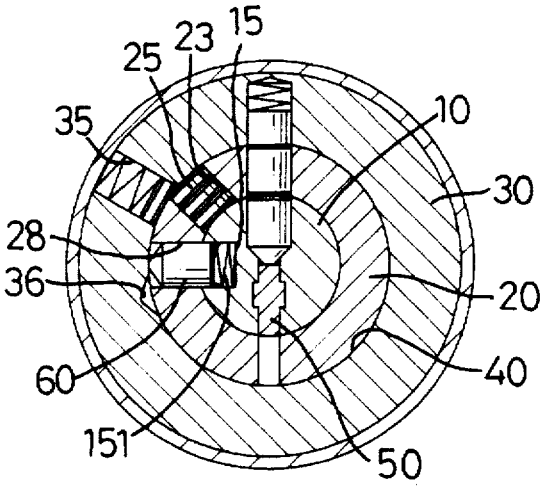
FIG. 18 is a sectional view transversely showing a first driver transmitting a second driver with a stopping pin in a sixth preferred embodiment of a repeatable coding lock according to the present invention.
Figure 19:
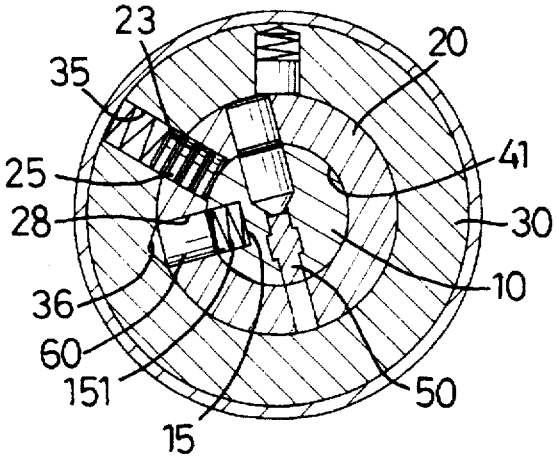
FIG. 19 is a sectional view transversely showing a stopping pin aligning with a cavity in a sixth preferred embodiment of a repeatable coding lock according to the present invention.
Figure 20:
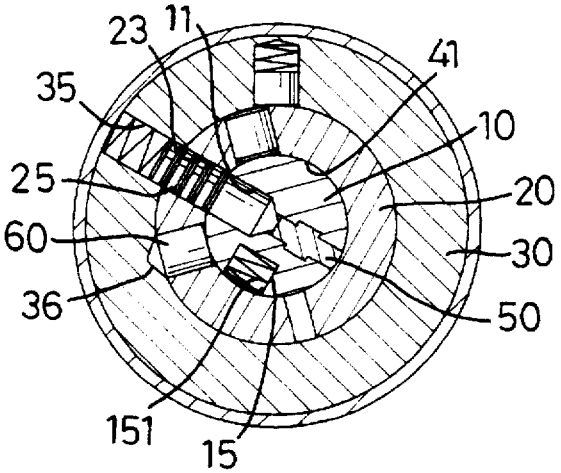
FIG. 20 is a sectional view transversely showing a stopping pin approaching a side hole of a second driver after completely leaving the cavity in a sixth preferred embodiment of a repeatable coding lock according to the present invention.

The second designation referring to FIG. 18 is that the first driver 10 further comprises at a location different from the peripheral hole 11 a positioning slot 15 for receiving therein a third elastic element 151 and a stopping pin 60, and the second driver 20 further comprises a positioning hole 23 which is provided with a side hole 28. The stopping pin 60 passes through the side hole 28 to butt against the turning interface 40 and in turn stops at a cavity 36 provided in said first driver 10. To set the code with this designation, when the turned by the setting key 50, the stopping pin 60 will be carried to simultaneously transmit the second driver 20. Furthermore, when the stopping pin 60 butts into the cavity 36, the second slot 35 will carry with the fourth locking element 25 to radially align with the positioning hole 23 as shown in FIG. 19. In a subsequent movement, the stopping pin 60 will leave the positioning slot 15 and completely stay in the side hole 28 to let the setting interface 41 move freely. Referring to FIG. 20, when the first driver 10 is further transmitted with the setting key 50, the peripheral hole 11 can be turned to correspond with the positioning hole 23 so as to receive the fourth locking element 25. As a result, the coding formation of the lock can now be renewed with another setting key.

What is claims:

1. A repeatable coding lock comprising:

a) a first elastic element;

b) a second elastic element;

c) a first locking element;

d) a second locking element;

e) a third locking element;

f) a fourth locking element;

g) a tube having a first slot for receiving therein the first elastic element and the first locking element;

h) a first driver having i) a locking through strip and ii) a peripheral hole for receiving therein the second locking element;

i) a second driver having i) a through hole for receiving therein the third locking element so as to A) externally and correspondingly position said third locking element at said first locking element of said tube and B) internally axially contain said first driver and said second driver and ii) a positioning hole for receiving therein the second elastic element and the fourth locking element; and j) a driving means, in correspondence with said locking through strip, for simultaneously driving said first driver and said second driver.

2. A repeatable coding lock according to claim 1, wherein said driving means is an opening slot (26).

3. A repeatable coding lock according to claim 1, wherein said second driver (20) has at one end a stopper (27) having an opening slot (271) penetratingly corresponding to said locking through strip (13).

4. A repeatable coding lock according to claim 1, wherein said driving means consists of a pin in said through hole.

5. A repeatable coding lock according to claim 1, wherein said tube (30) further comprises a second slot (35) which in an instance is adapted to be penetratingly in alignment with said positioning hole (23) to define an inner slot for superimposingly receiving therein a third elastic element (34) and said fourth locking element (25).

6. A repeatable coding lock according to claim 1, wherein said positioning hole (23) receives therein a magnet (251) and a magnetic pin (25).

7. A repeatable coding lock according to claim 1, wherein said tube (30) is adapted to fit in a locking body fixedly mounted on a door.

8. A repeatable coding lock according to claim 1, wherein said first elastic element is a spring.

9. A repeatable coding lock according to claim 1, wherein said second elastic element is a spring.

10. A repeatable coding lock comprising:

a) a first elastic element;

b) a second elastic element;

c) a first locking element;

d) a second locking element;

e) a third locking element;

f) a fourth locking element;

g) a tube having i) a first slot for receiving therein the first elastic element and the first locking element and ii) a second slot for receiving therein the second elastic element;

h) a first driver having i) a locking through strip, ii) a peripheral hole for receiving therein the second locking element and iii) a first stopping element; and i) a second driver having i) a through hole for receiving therein the third locking element so as to A) externally correspondingly position said third locking element at said first locking element of said tube and B) internally axially contain said first driver and said second driver and ii) a positioning hole for receiving therein the fourth locking element, wherein the second driver forms, in correspondence with said first stopping element, a second stopping element.

11. A repeatable coding lock comprising:

a) a first locking element;

b) a second locking element;

c) a third locking element;

d) a fourth locking element;

e) a first elastic element;

f) a second elastic element;

g) a third elastic element;

h) a stopping pin;

i) a tube having i) a first slot for receiving therein the first elastic element and the first locking element, ii) a second slot for receiving therein the second elastic element and iii) a cavity;

j) a first driver having
  i) a locking through strip,
  ii) a peripheral hole for receiving therein the second locking element and
  iii) a positioning slot for receiving therein the third elastic element and the stopping pin, k) a second driver having
  i) a through hole for receiving therein the third locking element so as to
    A) externally correspondingly position said third locking element at said first locking element of said tube and
    B) internally axially contain said first driver and said second driver
  ii) a side hole and
  iii) a positioning hole for receiving therein the fourth locking element.

12. A repeatable coding lock according to claim 11, wherein said positioning slot (15) is provided in said tube (30) and said cavity (36) is provided in said first driver (10).

13. A lock for use with a lock code setting key and a new lock code setting key, the lock comprising:

a) a first biasing element;

b) a second biasing element;

c) a first locking element;

d) a second locking element;

e) a third locking element;

f) a fourth locking element;

g) a first cylindrical tube defining an inner surface and an outer surface and having a first radially extending slot defined therein, said first radially extending slot starting at the inner surface of the cylindrical tube and adapted for receiving the first biasing element and the first locking element, wherein the first locking element is urged radially inward by the first biasing element;

h) a driving element defining an outer cylindrical surface and having
  i) an axially extending key hole and
  ii) a radially extending peripheral hole adapted for receiving the second locking element; and i) a second cylindrical tube defining an inner surface, which defines a first interface with the outer cylindrical surface defined by the driving element, and an outer surface, which defines a second interface with the inner cylindrical surface defined by the first cylindrical tube, and having
  i) a radially extending through hole adapted for receiving the third locking element and
  ii) a radially extending positioning hole adapted for receiving the second biasing element and the fourth locking element, wherein the fourth locking element is biased radially inward by the second biasing element, wherein, a locking code of the lock is adapted to be changed when (1) the lock code setting key is inserted into the keyhole thereby positioning the third locking element such that a first end is aligned with the first interface and a second end is aligned with the second interface, (2) the lock code setting key is turned such that the second biasing element pushes the fourth locking element against the second locking element, (3) the lock code setting key is removed from the keyhole, and (4) the new lock code setting key is inserted into the keyhole.

* * * * *